US010569334B2

(12) United States Patent
Yamazaki et al.

(10) Patent No.: US 10,569,334 B2
(45) Date of Patent: Feb. 25, 2020

(54) PROCESS FOR PRODUCING NOBLE-METAL POWDER

(71) Applicant: Tanaka Kikinzoku Kogyo K.K., Chiyoda-ku, Tokyo (JP)

(72) Inventors: Takahisa Yamazaki, Hiratsuka (JP); Akio Nagaoka, Hiratsuka (JP)

(73) Assignee: TANAKA KIKINZOKU KOGYO K.K., Tokyo (JP)

( * ) Notice: Subject to any disclaimer, the term of this patent is extended or adjusted under 35 U.S.C. 154(b) by 207 days.

(21) Appl. No.: 15/761,136

(22) PCT Filed: Sep. 12, 2016

(86) PCT No.: PCT/JP2016/076777
§ 371 (c)(1),
(2) Date: Mar. 19, 2018

(87) PCT Pub. No.: WO2017/047542
PCT Pub. Date: Mar. 23, 2017

(65) Prior Publication Data

US 2018/0264555 A1 Sep. 20, 2018

(30) Foreign Application Priority Data

Sep. 18, 2015 (JP) ..... 2015-185231

(51) Int. Cl.
*B22F 9/24* (2006.01)
*C22C 5/02* (2006.01)
(Continued)

(52) U.S. Cl.
CPC ..... *B22F 9/24* (2013.01); *B22F 1/0085* (2013.01); *C22C 1/0466* (2013.01); *C22C 5/02* (2013.01);
(Continued)

(58) Field of Classification Search
CPC ..... B22F 9/00; B22F 9/24
See application file for complete search history.

(56) References Cited

U.S. PATENT DOCUMENTS

2010/0279116 A1 11/2010 Irizarry
2013/0202909 A1 8/2013 Byun et al.

FOREIGN PATENT DOCUMENTS

CN 101823691 A 9/2010
JP 10-102103 A 4/1998
(Continued)

OTHER PUBLICATIONS

International Search Report for PCT/JP2016/076777, dated Nov. 29, 2016.
(Continued)

*Primary Examiner* — Melvin C. Mayes
*Assistant Examiner* — Danielle M. Carda
(74) *Attorney, Agent, or Firm* — Orrick, Herrington & Sutcliffe LLP; Joseph A. Calvaruso; K. Patrick Herman

(57) ABSTRACT

The present invention provides a process for producing a noble-metal powder, the process being capable of producing, at low cost, a noble-metal powder having a narrow particle-size distribution range, high purity and high crystallinity. The present invention relates to a process for producing a noble-metal powder and including a step in which an acidic aqueous solution of both one or more noble-metal compounds and a calcium compound is prepared, a step in which the acidic aqueous solution is added to a basic aqueous solution to yield one or more oxides or hydroxides of the noble metal(s) or a mixture of two or more thereof and yield a calcium hydroxide, a step in which the oxides or hydroxides of the noble metal(s) or the mixture is
(Continued)

reduced with a reducing agent, and a step in which a solid matter including a reduced form of the noble metal(s) is separated and heat-treated.

7 Claims, 2 Drawing Sheets

(51) Int. Cl.

| | |
|---|---|
| ***B22F 1/00*** | (2006.01) |
| ***C22C 5/04*** | (2006.01) |
| ***C22C 1/04*** | (2006.01) |
| *C22C 5/00* | (2006.01) |
| *H01B 1/02* | (2006.01) |

(52) U.S. Cl.

CPC ..... *C22C 5/04* (2013.01); *B22F 1/0014* (2013.01); *B22F 2201/10* (2013.01); *B22F 2301/25* (2013.01); *B22F 2998/10* (2013.01); *B22F 2999/00* (2013.01); *C22C 5/00* (2013.01); *H01B 1/02* (2013.01)

(56) References Cited

FOREIGN PATENT DOCUMENTS

| | | | |
|---|---|---|---|
| JP | 10-102109 | A | 4/1998 |
| JP | 10-183208 | A | 7/1998 |
| JP | 2006-199982 | A | 8/2006 |
| JP | 2008-95174 | A | 4/2008 |

OTHER PUBLICATIONS

Extended Search Report for EP Application No. 16846413.9, dated Sep. 20, 2018.

[Fig. 1]
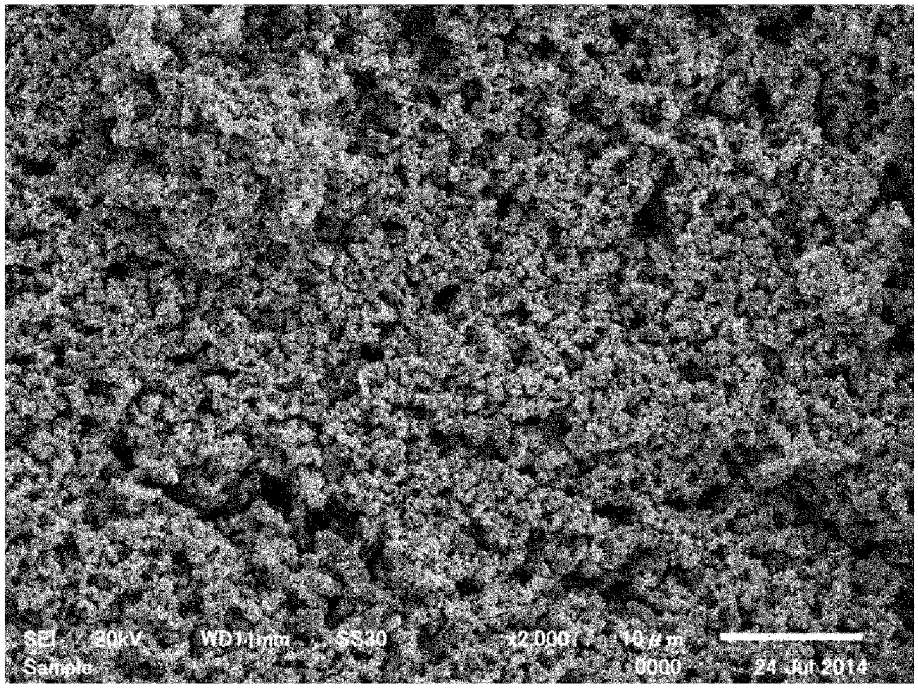
[Fig.2]
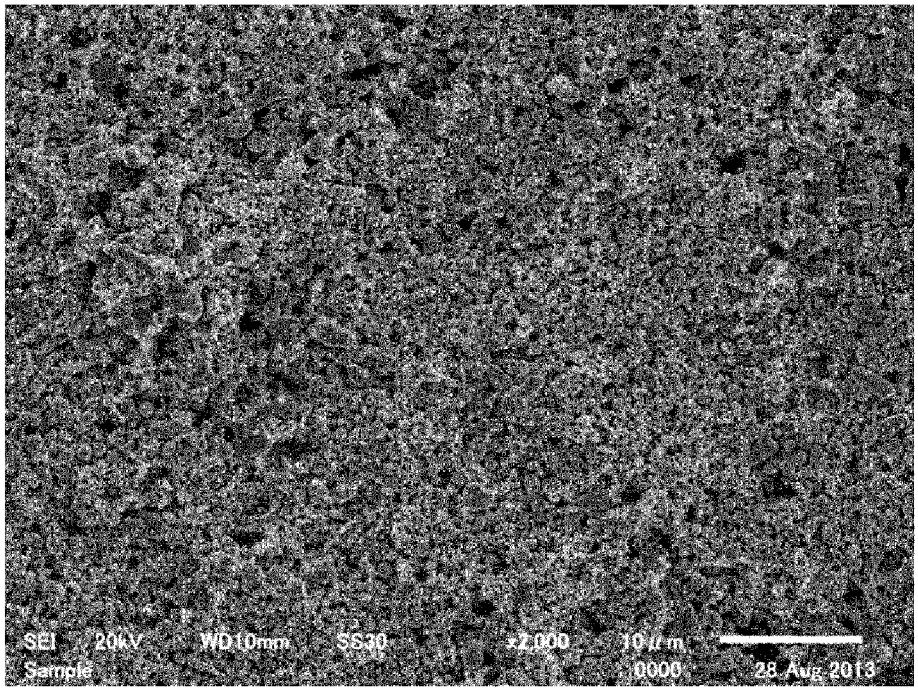

[Fig.3]
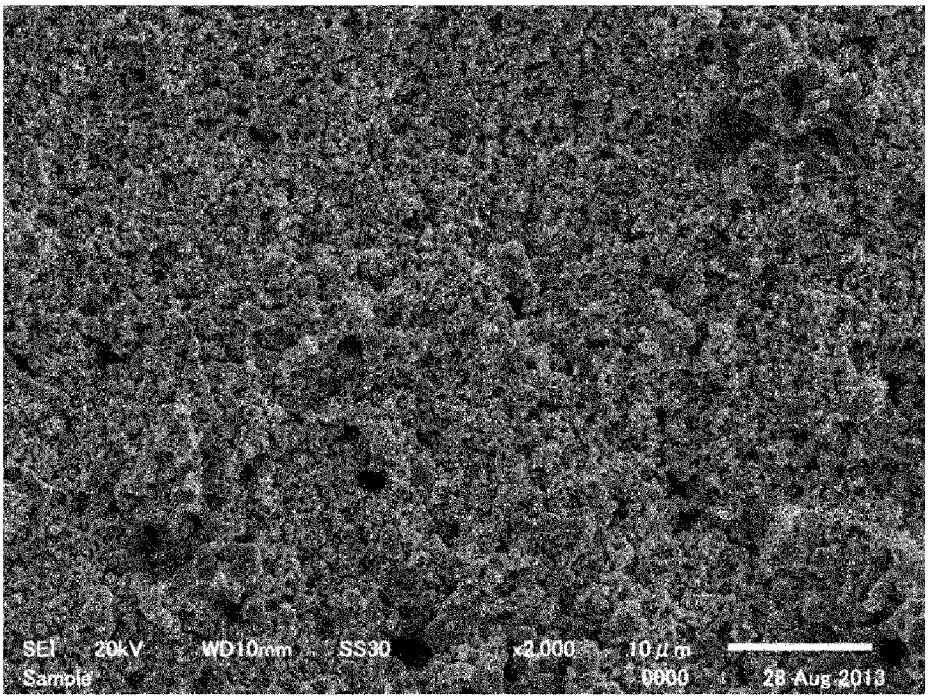
[Fig.4]
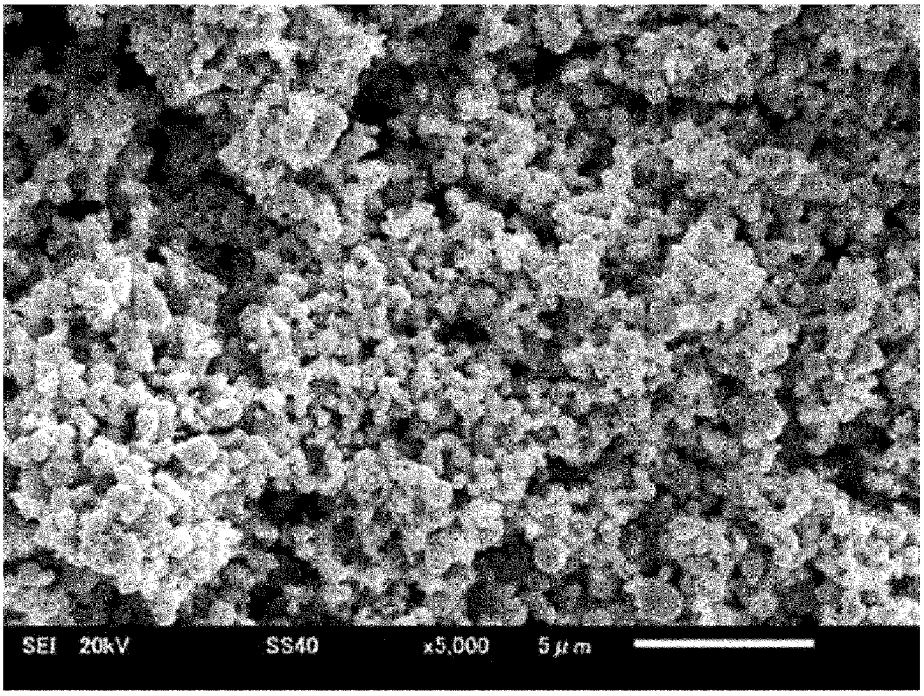

PROCESS FOR PRODUCING NOBLE-METAL POWDER

TECHNICAL FIELD

The present invention relates to a process for producing a noble-metal powder, in particular, a process for producing a noble-metal powder for pastes for thick-film formation which are used mainly for electronic appliances.

BACKGROUND ART

With the recent trend toward size reduction in electronic appliances, the electronic components for use therein are more and more required to be reduced in size. In functional components employing ceramics, such as inductors and capacitors, among those electronic components, size reductions and characteristics improvements have come to be attained by a multilayer structure. Such a multilayer component is produced by dispersing a metal powder, e.g., a noble-metal powder, in an organic-binder-containing organic solvent to obtain an electroconductive paste, printing the paste on a ceramic green sheet, subjecting the green sheet to the steps of stacking, press bonding, and cutting, thereafter burning the green sheet, and forming external electrodes.

Noble-metal powders for use in such electroconductive pastes are required to have a narrow particle-size distribution range and to have high purity and high crystallinity.

Patent Document 1, for example, describes a feature wherein a platinum powder having a narrow particle-size distribution range and high purity is obtained by a process for obtaining a highly crystalline platinum powder, in which platinum black is mixed with calcium carbonate by a wet process, the mixture is dried, subsequently pulverized, and then burned to remove carbon dioxide, the remaining calcium oxide is dissolved away with a dilute acid and removed by washing with water, and the residue is dried to obtain a platinum powder.

However, in the case where the process described in Patent Document 1 is used, there has been a problem in that the highly crystalline platinum powder to be obtained considerably varies in property in cases when either the platinum black, which is a platinum powder, or the calcium carbonate has abnormal properties. Furthermore, since platinum black, which is a platinum powder, is produced first and this platinum black is subjected to the treatments, including wet-process mixing with calcium carbonate, to produce a highly crystalline platinum powder, it is necessary to produce a platinum powder twice in total. The process described in Patent Document 1 hence has had a problem in that the number of production steps is large, resulting in an increase in cost.

Patent Document 2 describes, as a process for overcoming such problems, a process for producing a fine powder of one or more metals selected from among platinum, gold, rhodium, palladium, silver, copper, and nickel, the process being characterized by including: an aqueous-metal-compound-solution preparation step in which one or more water-soluble compounds of the metal(s) are dissolved in water to obtain an aqueous solution thereof having a pH of 4 or less; a reaction step in which a powder of the hydroxide(s) of one or more Group 2A element metals of the periodic table selected from among calcium hydroxide, magnesium hydroxide, and barium hydroxide and/or an aqueous slurry of the hydroxide(s) is mixed with the aqueous solution having a pH of 4 or less and the pH of the resultant mixture is adjusted to 10 or higher; a first separation step in which the insoluble solid obtained through the reaction step is taken out and dried; a heat treatment step in which the separated insoluble solid is heated in an inert gas or hydrogen gas atmosphere at a temperature which is 800° C. or higher but is not higher by 100° C. or more than the lowest of the melting points of the selected metals; an acid treatment step in which the solid that has undergone the heat treatment is immersed in an aqueous acid solution and the pH is kept at 4 or less; and a second separation step in which the metal particles present in the aqueous acid solution used in the acid treatment are taken out, washed, and dried.

PRIOR ART DOCUMENTS

Patent Documents

Patent Document 1: JP-A-H10-102103
Patent Document 2: JP-A-2006-199982

SUMMARY OF THE INVENTION

Problems that the Invention is to Solve

However, in the process described in Patent Document 2, either the powder of the hydroxide(s) of one or more Group 2A element metals of the periodic table or the slurried powder thereof is mixed with noble-metal particles which are being yielded in the liquid, only by stirring the liquid. This process hence is unable to evenly mix the noble-metal particles with the powder of the hydroxide(s) of one or more Group 2A element metals of the periodic table, as compared with wet-process mixing, and the liquid comes to contain agglomerates of noble-metal particles in a large amount. There has hence been a problem in that the resultant product, upon firing, partly yields coarse particles, making it difficult to obtain an even particle diameter.

In view of the problems of the prior-art techniques, an object of the present invention is to provide a process for producing a noble-metal powder, the process being capable of producing, at low cost, a noble-metal powder which has a narrow particle-size distribution range and has high purity and high crystallinity.

Means for Solving the Problems

The present inventors diligently made investigations and, as a result, have discovered that the problems described above can be solved by the following process for producing a noble-metal powder. The present invention has been thus completed.

Thus, the present invention relates to a process for producing a noble-metal powder, the process comprising: a step in which an acidic aqueous solution of both one or more noble-metal compounds and a calcium compound is prepared, a step in which the acidic aqueous solution is added to a basic aqueous solution to yield one or more oxides or hydroxides of the noble metal(s) or a mixture of two or more thereof and further yield a calcium hydroxide, a step in which the oxides or hydroxides of the noble metal(s) or the mixture of two or more thereof is reduced with a reducing agent, and a step in which a solid matter including a reduced form of the noble metal(s) is separated and heat-treated.

With respect to the process for producing a noble-metal powder of the present invention, it is preferable to further include, after the step of heat treatment, a step in which the heat-treated product obtained is subjected to an acid treatment.

With respect to the process for producing a noble-metal powder of the present invention, when preparing the acidic aqueous solution, the one or more noble-metal compounds and the calcium compound are used is preferably in a ratio of from 10:1 to 0.2:1 in terms of weight ratio on an atomic basis [(noble-metal atoms):(calcium atoms)].

With respect to the process for producing a noble-metal powder of the present invention, it is preferable that the acidic aqueous solution is added to the basic aqueous solution by dropping the acidic aqueous solution into the basic aqueous solution.

With respect to the process for producing a noble-metal powder of the present invention, it is preferable that after all of the acidic aqueous solution has been added to the basic aqueous solution, the resultant liquid reaction mixture is basic.

With respect to the process for producing a noble-metal powder of the present invention, the heat treatment is preferably conducted at a temperature of 800° C. or higher.

With respect to the process for producing a noble-metal powder of the present invention, the heat treatment is preferably conducted in an inert atmosphere or a reducing atmosphere.

Effects of the Invention

According to the process of the invention for producing a noble-metal powder, it is possible to produce, at low cost, a noble-metal powder which has a narrow particle-size distribution range and has high purity and high crystallinity.

BRIEF DESCRIPTION OF THE DRAWINGS

FIG. 1 is an SEM photograph of the platinum powder obtained in Example 1.

FIG. 2 is an SEM photograph of the platinum powder obtained in Comparative Example 1.

FIG. 3 is an SEM photograph of the platinum powder obtained in Comparative Example 2.

FIG. 4 is an SEM photograph of the gold powder obtained in Example 2.

MODES FOR CARRYING OUT THE INVENTION

Embodiments of the process for producing a noble-metal powder of the invention are explained below in detail. Hereinafter, the process for producing a noble-metal powder of the invention is often referred to simply as "production process of the invention".

The process for producing a noble-metal powder of the invention includes: a step in which an acidic aqueous solution of both one or more noble-metal compounds and a calcium compound is prepared (hereinafter referred to also as "acidic-aqueous-solution preparation step"); a step in which the acidic aqueous solution is added to a basic aqueous solution to yield one or more oxides or hydroxides of the noble metal(s) or a mixture of two or more thereof and further yield a calcium hydroxide (hereinafter referred to also as "reaction step"); a step in which the oxides or hydroxides of the noble metal(s) or the mixture of two or more thereof is reduced with a reducing agent (hereinafter referred to also as "reduction step"); and a step in which a solid matter including a reduced form of the noble metal(s) is separated and heat-treated (hereinafter referred to also as "heat treatment step"). It is preferable that the process for noble-metal production of the invention should further include, after the heat treatment step, a step in which the heat-treated product obtained is subjected to an acid treatment (hereinafter referred to also as "acid treatment step").

In the production process of the invention, the noble metal(s) included in the noble-metal powder to be produced may be any noble metal(s). Examples thereof include one or more noble metals selected from among gold (Au), silver (Ag), platinum (Pt), palladium (Pd), rhodium (Rh), iridium (Ir), and ruthenium (Ru).

(Acidic-Aqueous-Solution Preparation Step)

In the production process of the invention, an acidic aqueous solution of both one or more noble-metal compounds (hereinafter also referred to simply as "noble-metal compounds") and a calcium compound is prepared first.

The noble-metal compounds are not particularly limited. Examples thereof include platinum compounds, gold compounds, rhodium compounds, palladium compounds, iridium compounds, silver compounds, and ruthenium compounds.

Examples of the platinum compounds include hexachloroplatinic(IV) acid, tetrachloroplatinic(II) acid, and tetraammineplatinic(II) acid.

Examples of the gold compounds include chloroauric(III) acid, tetrachloroauric(III) acid, and ammonium tetrachloroaurate(III).

Examples of the rhodium compounds include rhodium (III) nitrate and ammonium hexachlororhodate(III).

Examples of the palladium compounds include palladium (II) nitrate and tetraamminepalladium(II) nitrate.

Examples of the iridium compounds include iridium oxide, iridium chloride, and iridium nitrate.

Examples of the silver compounds include silver chloride, silver nitrate, and silver acetate.

Examples of the ruthenium compounds include ruthenium (IV) oxide, ruthenium(III) chloride, and ruthenium(III) nitrate.

One or more such noble-metal compounds can be suitably selected and used while taking account of the kinds of the noble metals to be included in the desired noble-metal powder.

The calcium compound is an ingredient that becomes calcium hydroxide in the reaction step, which will be described later, and then becomes calcium oxide through pyrolysis in the subsequent heat treatment step, thereby functioning as a spacer for inhibiting the growth of noble-metal particles in the heat treatment step.

The calcium compound is not particularly limited so long as the compound is soluble in the acidic aqueous solution. Examples thereof include calcium carbonate, calcium hydroxide, calcium oxide, calcium sulfate, calcium chloride, and calcium nitrate. Preferred of these are calcium chloride and calcium nitrate, since the two compounds readily dissolve in water and are easy to handle.

The compounds shown above other than calcium chloride and calcium nitrate are sparingly soluble in water. However, aqueous solutions of noble-metal compounds are strongly acidic in many cases, and it is possible to dissolve those calcium compounds in such aqueous solutions of noble-metal compounds. However, when dissolving those compounds in an aqueous solution of noble-metal compounds, there are cases where heat generation occurs and a thermal alteration occurs. It is hence preferred to use calcium chloride or calcium nitrate. One of those calcium compounds may be used alone, or two or more thereof may be used in combination.

When preparing the acidic aqueous solution, the ratio in which the one or more noble-metal compounds and the calcium compound are to be used is not particularly limited. However, in case where the proportion of the noble-metal compounds is too large, the proportion of the calcium compound is too small, resulting in a tendency that necking occurs frequently in the heat treatment, which will be described later, making it difficult to obtain noble-metal particles having evenness in particle diameter.

Meanwhile, in case where the proportion of the noble-metal compounds is too small, the effect of adding the calcium compound tends not to be enhanced any more, resulting in the necessity of using a larger amount of an acid for removing calcium oxide in the acid treatment, which will be described later. Consequently, the ratio in which the noble-metal compounds and the calcium compound are used is preferably from 10:1 to 0.2:1, more preferably from 2:1 to 0.5:1, in terms of weight ratio on an atomic basis [(noble-metal atoms):(calcium atoms)].

Methods for preparing the acidic aqueous solution of one or more noble-metal compounds and a calcium compound are not particularly limited. For example, use may be made of a method in which an aqueous solution of the noble-metal compounds is produced and the calcium compound is dissolved therein to thereby prepare the acidic aqueous solution. Alternatively, use may be made of a method in which an aqueous solution of the calcium compound is prepared and the noble-metal compounds are dissolved therein to thereby prepare the acidic aqueous solution. Use may also be made of a method in which an aqueous solution of the noble-metal compounds and an aqueous solution of the calcium compound are separately prepared, and these solutions are mixed together to thereby prepare the acidic aqueous solution.

Some combinations of one or more noble-metal compounds with a calcium compound give the desired acidic aqueous solution when being merely dissolved in water. However, an acid may be added according to need during any one or more stages for preparing the acidic aqueous solution. Preferred of the methods shown above is the method in which an acidic aqueous solution of the noble-metal compounds is prepared beforehand and the calcium compound is dissolved therein or an aqueous solution of the calcium compound is mixed therewith, thereby preparing an acidic aqueous solution of both the noble-metal compounds and the calcium compound.

The acid to be used here may be any acid which is capable of enhancing the solubility of the noble-metal compounds or calcium compound in water or capable of regulating the aqueous solution so as to have the desired acidity. Examples thereof include inorganic acids such as hydrochloric acid and nitric acid and organic acids such as acetic acid and formic acid. Although sulfuric acid can be used, it may be necessary to minimize inclusion of sulfur atoms, depending on the intended use of the fine metal particles to be yielded. In such cases, use of sulfuric acid is undesirable.

The pH of the acidic aqueous solution to be prepared is not particularly limited so long as the solution is acidic. From the standpoint of preventing the noble metals from precipitating as oxides or hydroxides, the pH of the solution is preferably 4 or less, more preferably 2 or less, even more preferably 1 or less.

(Reaction Step)

In the production process of the invention, the acidic aqueous solution prepared in the manner shown above is added to a basic aqueous solution to yield one or more oxides or hydroxides of the noble metal(s) or a mixture of two or more thereof and further yield a calcium hydroxide.

As the basic aqueous solution, use can be made, for example, of an aqueous sodium hydroxide solution, an aqueous potassium hydroxide solution, ammonia water, or the like. The pH of the basic aqueous solution is not particularly limited so long as the solution is basic. However, from the standpoint of efficiently and appropriately causing the calcium compound to precipitate as the hydroxide, the pH of the solution is preferably 11 or higher, more preferably 12 or higher.

The ratio in which the acidic aqueous solution is added to the basic aqueous solution may be suitably regulated while taking account of the pH of the acidic aqueous solution, the pH of the basic aqueous solution, etc. It is preferable that the basic aqueous solution should be prepared in an amount sufficient for neutralizing the acidic aqueous solution, which contains the noble-metal compounds and a calcium compound dissolved therein. Namely, it is preferred to use the basic aqueous solution in an amount sufficient for precipitating one or more oxides or hydroxides of the noble metal(s) or a mixture of two or more thereof and further precipitating a calcium hydroxide.

In the production process of the invention, it is important that the solution to be added should be the acidic aqueous solution, that is, the acidic aqueous solution be added to the basic aqueous solution. For example, it is preferred to suitably use a feed pump, pipette, dropping pipette, funnel, etc. to add the acidic aqueous solution to the basic aqueous solution with stirring either at a time or dropwise gradually.

Thus, the acidic aqueous solution, in which noble-metal ions and calcium ions are evenly dispersed, is added to the aqueous solution which is basic, preferably strongly basic. This addition hence results, instantaneously or thereafter, in the formation of one or more oxides or hydroxides of the noble metal(s) or a mixture of two or more thereof and in the formation of a calcium hydroxide. The former formation and the latter formation begin approximately simultaneously, or the formation of calcium hydroxide begins and, immediately thereafter, the formation of one or more oxides or hydroxides of the noble metal(s) or a mixture of two or more thereof begins. That is, the formation of one or more oxides or hydroxides of the noble metal(s) or a mixture of two or more thereof begins before completion of the formation of a calcium hydroxide and, hence, a liquid containing these compounds evenly dispersed therein is obtained.

By the succeeding steps, a noble-metal powder having a narrow particle-size distribution range and evenness in particle diameter can hence be obtained. When adding the acidic aqueous solution to the basic aqueous solution, it is preferred to add the acidic aqueous solution to the basic aqueous solution which is being stirred.

In the production process of the invention, noble-metal particles are yielded from the solutions in which the noble-metal compounds and the calcium compound are in the state of having been dissolved in water. Consequently, control of the reaction conditions makes it possible to control the particle diameters of the noble-metal particles and calcium hydroxide particles and to control the mixing ratio therebetween. This makes it possible to control the properties of the noble-metal powder to be obtained and renders quality stabilization possible.

It is preferable that after all the acidic aqueous solution has been added to the basic aqueous solution, the resultant liquid reaction mixture should be basic. As a result, the noble-metal hydroxides and calcium hydroxide which have been yielded can be stably present in the liquid reaction mixture. The pH of the liquid reaction mixture obtained by adding all the acidic aqueous solution to the basic aqueous solution is preferably 11 or higher, more preferably 12 or higher.

Meanwhile, in case where the basic aqueous solution is gradually added to the acidic aqueous solution, the pH gradually increases from the acidic region to the basic region. In this case, the formation of noble-metal hydroxides begins first, followed by the formation of a calcium hydroxide. Consequently, the formation of noble-metal hydroxides and the formation of calcium hydroxide do not occur simultaneously in this case. As a result, the noble-metal hydroxides which have been yielded in first form masses of particles consisting mainly of noble metals and not surrounded by calcium, and such masses serve as a precursor for coarse particles, making it difficult to obtain an even particle diameter.

(Reduction Step)

In the production process of the invention, the reaction step is followed by reducing the one or more oxides or hydroxides of the noble metal(s) or the mixture of two or more thereof, with a reducing agent. Specifically, a reducing agent is added to the liquid obtained by the reaction step, which contains one or more oxides or hydroxides of the noble metal(s) or a mixture of two or more thereof and which further contains a calcium hydroxide, to reduce the noble-metal oxides or hydroxides or the mixture in the liquid.

The reducing agent to be used is not particularly limited so long as the reducing agent can reduce the noble-metal oxides or hydroxides or the mixture of two or more thereof. Examples of the reducing agent include hydrazine, formalin, glucose, hydroquinone, hydroxylammonium chloride, and sodium formate. From the standpoints of precipitation efficiency and evenness in particle diameter, hydrazine is preferred for platinum, and hydroxylammonium chloride is preferred for gold. The amount of the reducing agent to be used is not particularly limited so long as the amount thereof is sufficient for reducing the noble-metal oxides or hydroxides or the mixture of two or more thereof.

(Heat Treatment Step)

In the production process of the invention, a solid matter (insoluble matter) including a reduced form of the noble metals is separated from the liquid in which the noble-metal oxides or hydroxides or the mixture of two or more thereof has been reduced, and is then heat-treated (burned). In the production process of the invention, a liquid in which noble-metal oxides or hydroxides or a mixture of two or more thereof and a calcium hydroxide are evenly dispersed is obtained in the reaction step, and this liquid is subjected to the reduction step and then to separation of a solid matter (insoluble matter) therefrom. Consequently, in the separated solid matter, a reduced form of the noble metals and calcium hydroxide are contained in an evenly dispersed state. By giving a heat treatment to this solid matter, the noble metals in the reduced form, which have a valence of 0, come into a semi-fused state and aggregate gradually.

Meanwhile, the coexistent calcium hydroxide is pyrolyzed into calcium oxide. Morphologically, the noble metals in the reduced form, which have a valence of 0, come into a semi-fused state and aggregate gradually, but the aggregation is inhibited by surrounding with calcium oxide, which is a thermally stable solid. The noble metals in the reduced form come into a state in which the calcium oxide has been disposed so as to surround the noble-metal particles which are aggregating. Thus, the noble metals in the reduced form, which are in the state of being evenly dispersed together with the calcium hydroxide, are caused to undergo particle growth in an environment where free growth of noble-metal particles is impossible. It is hence possible to obtain noble-metal particles which have evenness in particle diameter, a narrow particle-diameter distribution range, high purity, and high crystallinity.

For the separation of a solid matter including a reduced form of the noble metals from the liquid in which the noble-metal oxides or hydroxides or the mixture of two or more thereof has been reduced, a conventionally known solid/liquid separation method can be suitably selected and used, such as filtration or centrifugal separation. After the separation of the solid matter, this solid matter may be dried according to need to remove the water adherent to the solid matter. The drying temperature is not particularly limited, and the drying can be conducted, for example, at 80-200° C.

The heat treatment temperature for the heat treatment of the separated solid matter is not particularly limited. However, from the standpoint of further improving the purity and crystallinity of the noble-metal powder, the heat treatment temperature is preferably 800° C. or higher, more preferably 900° C. or higher. There is no particular upper limit on the heat treatment temperature. From the standpoint of control for attaining evenness in particle diameter, it is preferable that the heat treatment temperature should be not higher by 100° C. or more than the melting point of the noble metal which is the lowest in melting point among the noble metals included in the desired noble-metal particles.

The heat treatment period also is not particularly limited. However, the heat treatment period is preferably 0.2-5 hours, more preferably 0.5-3 hours. Heat treatment periods of 0.2 hours and longer are preferred since the noble-metal particles grow sufficiently. Heat treatment periods of 5 hours and shorter are preferred since the production efficiency is high.

When giving the heat treatment to the separated solid matter, it is preferred to use a heat treatment atmosphere which is an inert atmosphere, such as nitrogen, argon, or helium, or a reducing atmosphere, such as hydrogen, since some kinds of noble metals are affected by oxidation.

(Acid Treatment Step)

In the production process of the invention, after the step of heat treatment, it is preferable that the heat-treated product obtained through the heat treatment step should be subjected to an acid treatment. The heat-treated product which has undergone the heat treatment includes noble-metal particles and a calcium oxide. By the acid treatment, the calcium oxide only is dissolved in the acid to leave the noble-metal particles (powder) only. Thus, the component(s) other than the noble-metal powder can be removed.

The acid treatment may be conducted by immersing and holding the heat-treated product in an aqueous solution of an acid. The acid to be used here may be any acid which is capable of dissolving only the calcium oxide in the water without dissolving the desired noble-metal fine particles. For the noble metals which are one or more metals selected from between platinum and gold, preferred examples of the acid include one or more acids selected from among hydrochloric acid, nitric acid, and acetic acid. Meanwhile, acetic acid is a preferred example of the acid, for the noble metals which include one or more metals selected from among rhodium, palladium, silver, ruthenium, and iridium.

The amount of the acid to be used in the acid treatment may be any amount sufficient for reaction with the calcium oxide. Actually, however, the heat-treated product is immersed in an aqueous acid solution in which the acid is present in excess, thereby performing the treatment so that the solution can retain acidity. It is preferred to perform the acid treatment step while stirring the mixture. After the acid treatment, washing such as water washing, drying, etc. are performed according to need. Thus, the desired noble-metal powder can be obtained. Although the drying temperature is not particularly limited, the powder can be dried, for example, at 80-200° C.

The production process of the invention involves a small number of production steps and hence can yield, at low cost, a noble-metal powder which has a narrow particle-size distribution range (evenness in particle diameter), high purity, and high crystallinity.

EXAMPLES

The present invention is further explained below by reference to Examples, but the invention should not be limited to the following Examples.

Example 1

An aqueous calcium chloride solution was prepared by dissolving 55.5 g of calcium chloride in 200 g of pure water. Next, 243.9 g of a chloroplatinic acid solution (platinum content, 16.4% by weight) was added to the prepared aqueous calcium chloride solution, and this mixture was sufficiently stirred to prepare an acidic aqueous solution containing platinum ions and calcium ions. This acidic aqueous solution was added dropwise, over 10 minutes, to 500 g of 40% aqueous potassium hydroxide solution which had been heated to 50° C. and was kept being stirred. Thereto was then added 200 g of 5% hydrazine. The resultant mixture was stirred for further 1 hour and then cooled to room temperature, and the insoluble matter was thereafter taken out by filtration. The insoluble matter obtained was washed, subsequently dried at 120° C., and then heat-treated at 1,200° C. for 1 hour in a nitrogen atmosphere. Subsequently, 1 L of 3-mol/L nitric acid solution was prepared, and the heat-treated product was added thereto to conduct an acid treatment to dissolve away the calcium component. Thereafter, the residual solid matter was washed and dried at 120° C., thereby obtaining 39.4 g of a platinum powder. In FIG. 1 is shown an SEM photograph of the platinum powder obtained in Example 1.

Comparative Example 1

An aqueous calcium chloride solution was prepared by dissolving 55.5 g of calcium chloride in 200 g of pure water. Next, 243.9 g of a chloroplatinic acid solution (platinum content, 16.4% by weight) was added to the prepared aqueous calcium chloride solution, and this mixture was sufficiently stirred to prepare an acidic aqueous solution containing platinum ions and calcium ions. Five hundred grams of 40% aqueous potassium hydroxide solution was added dropwise, over 10 minutes, to the acidic aqueous solution which had been heated to 50° C. and was kept being stirred. Thereto was then added 200 g of 5% hydrazine. The resultant mixture was stirred for further 1 hour and then cooled to room temperature, and the insoluble matter was thereafter taken out by filtration. The insoluble matter obtained was washed, subsequently dried at 120° C., and then heat-treated at 1,200° C. for 1 hour in a nitrogen atmosphere. Subsequently, 1 L of 3-mol/L nitric acid solution was prepared, and the heat-treated product was added thereto to conduct an acid treatment to dissolve away the calcium component. Thereafter, the residual solid matter was washed and dried at 120° C., thereby obtaining 39.4 g of a platinum powder. In FIG. 2 is shown an SEM photograph of the platinum powder obtained in Comparative Example 1.

Comparative Example 2

A calcium hydroxide slurry was prepared by dispersing 148.2 g of calcium hydroxide in 500 g of pure water. To this calcium hydroxide slurry was added dropwise, over 10 minutes, a solution prepared by adding 200 g of pure water to 243.9 g of a chloroplatinic acid solution (platinum content, 16.4% by weight). Thereto was then added 200 g of 5% hydrazine. The resultant mixture was stirred for further 1 hour and then cooled to room temperature, and the insoluble matter was thereafter taken out by filtration. The insoluble matter obtained was washed, subsequently dried at 120° C., and then heat-treated at 1,200° C. for 1 hour in a nitrogen atmosphere. Subsequently, 1 L of 3-mol/L nitric acid solution was prepared, and the heat-treated product was added thereto to conduct an acid treatment to dissolve away the calcium component. Thereafter, the residual solid matter was washed and dried at 120° C., thereby obtaining 39.4 g of a platinum powder. In FIG. 3 is shown an SEM photograph of the platinum powder obtained in Comparative Example 2.

The platinum powders obtained in Example 1 and Comparative Examples 1 and 2 were examined for specific surface area by the BET method. The results of the examination are shown in Table 1.

The platinum powders obtained in Example 1 and Comparative Examples 1 and 2 were further examined for particle-size distribution using a laser diffraction type particle-size distribution analyzer (product name MT3000, manufactured by Nikkiso Co., Ltd.). In Table 1 are shown the thus-obtained results of examination concerning 10% volume-average particle diameter, 50% volume-average particle diameter, 90% volume-average particle diameter, and maximum particle diameter.

In Table 1 is also shown the element content ratio between platinum and calcium (weight ratio) in the dried powder (platinum/calcium mixture powder) obtained by drying the insoluble matter, which was the reaction product taken out by filtration and was to be heat-treated, in each of Example 1 and Comparative Examples 1 and 2.

TABLE 1

| | Specific surface area [$m^2/g$] | 10% volume-average particle diameter [μm] | 50% volume-average particle diameter [μm] | 90% volume-average particle diameter [μm] | Maximum particle diameter [μm] | Pt/Ca weight ratio in reaction product |
|---|---|---|---|---|---|---|
| Example 1 | 1.1 | 0.4 | 0.7 | 1.4 | 2.8 | 2.1 |
| Comparative Example 1 | 0.6 | 0.4 | 0.9 | 3.4 | 13.1 | 2.2 |

TABLE 1-continued

| | Specific surface area [$m^2/g$] | 10% volume-average particle diameter [μm] | 50% volume-average particle diameter [μm] | 90% volume-average particle diameter [μm] | Maximum particle diameter [μm] | Pt/Ca weight ratio in reaction product |
|---|---|---|---|---|---|---|
| Comparative Example 2 | 0.4 | 0.7 | 1.9 | 6.4 | 26.2 | 1.8 |

It was ascertained from the results that the platinum powder obtained in Example 1, in which the acidic aqueous solution had been added dropwise to 40% aqueous potassium hydroxide solution, had evenness in particle diameter as a whole and contained no coarse particles. Meanwhile, the platinum powders obtained in Comparative Example 1, in which 40% aqueous potassium hydroxide solution had been added dropwise to the acidic aqueous solution, and in Comparative Example 2, in which an aqueous chloroplatinic acid solution had been added to a calcium hydroxide slurry, were each ascertained to have a wide particle-diameter distribution and contain coarse particles.

Example 2

An aqueous calcium nitrate solution was prepared by dissolving 36.1 g of calcium nitrate in 36 g of pure water. Next, 35.3 g of a chloroauric acid solution (gold content, 17.0% by weight) was added to the prepared aqueous calcium nitrate solution, and this mixture was sufficiently stirred to prepare an acidic aqueous solution containing gold ions and calcium ions. This acidic aqueous solution was added dropwise, over 80 minutes, to 248 g of 40% aqueous potassium hydroxide solution which had been heated to 50° C. and was kept being stirred. Thereto was then added 17.1 g of 10% hydrazine hydrochloride. The resultant mixture was stirred for further 1 hour and then cooled to room temperature, and the insoluble matter was thereafter taken out by filtration. The insoluble matter obtained was washed, subsequently dried at 120° C., and then heat-treated at 800° C. for 1 hour in a nitrogen atmosphere. Subsequently, 1 L of 3-mol/L nitric acid solution was prepared, and the heat-treated product was added thereto to conduct an acid treatment to dissolve away the calcium component. Thereafter, the residual solid matter was washed and dried at 120° C., thereby obtaining 6.0 g of a gold powder. In FIG. 4 is shown an SEM photograph of the gold powder obtained in Example 2.

The gold powder obtained in Example 2 was examined for specific surface area by the BET method. The result of the examination is shown in Table 2.

The gold powder obtained in Example 2 was further examined for particle-size distribution using a laser diffraction type particle-size distribution analyzer (product name MT3000, manufactured by Nikkiso Co., Ltd.). In Table 2 are shown the thus-obtained results of examination concerning 10% volume-average particle diameter, 50% volume-average particle diameter, 90% volume-average particle diameter, and maximum particle diameter.

In Table 2 is also shown the element content ratio between gold and calcium (weight ratio) in the dried powder (gold/calcium mixture powder) obtained by drying the insoluble matter, which was the reaction product taken out by filtration and was to be heat-treated, in Example 2.

TABLE 2

| | Specific surface area [$m^2/g$] | 10% volume-average particle diameter [μm] | 50% volume-average particle diameter [μm] | 90% volume-average particle diameter [μm] | Maximum particle diameter [μm] | Au/Ca weight ratio in reaction product |
|---|---|---|---|---|---|---|
| Example 2 | 0.5 | 0.4 | 0.8 | 1.3 | 10.5 | 2.4 |

It was ascertained from the results that the gold powder obtained in Example 2, in which the acidic aqueous solution had been added dropwise to 40% aqueous potassium hydroxide solution as in Example 1, had evenness in particle diameter as a whole and contained substantially no coarse particles.

While the invention has been described in detail and with reference to specific embodiments thereof, it will be apparent to one skilled in the art that various changes and modifications can be made therein without departing from the spirit and scope thereof. This application is based on a Japanese patent application filed on Sep. 18, 2015 (Application No. 2015-185231), the entire contents thereof being incorporated herein by reference.

The invention claimed is:

1. A process for producing a noble-metal powder, the process comprising:

a step in which an acidic aqueous solution of both one or more noble-metal compounds and a calcium compound is prepared, a step in which the acidic aqueous solution is added to a basic aqueous solution to yield one or more oxides or hydroxides of the noble metal(s) or a mixture of two or more thereof and further yield a calcium hydroxide, a step in which the one or more oxides or hydroxides of the noble metal(s) or the mixture of two or more thereof is reduced with a reducing agent, and a step in which a solid matter including a reduced form of the noble metal(s) is separated and heat-treated.

2. The process for producing a noble-metal powder according to claim 1, which further includes, after the step of heat treatment, a step in which the heat-treated product obtained is subjected to an acid treatment.

3. The process for producing a noble-metal powder according to claim 1, wherein when preparing the acidic aqueous solution, the one or more noble-metal compounds and the calcium compound are used in a ratio of from 10:1 to 0.2:1 in terms of weight ratio on an atomic basis [(noble-metal atoms):(calcium atoms)].

4. The process for producing a noble-metal powder according to claim 1, wherein the acidic aqueous solution is added to the basic aqueous solution by dropping the acidic aqueous solution into the basic aqueous solution.

5. The process for producing a noble-metal powder according to claim 1, wherein after all of the acidic aqueous solution has been added to the basic aqueous solution, the resultant liquid reaction mixture is basic.

6. The process for producing a noble-metal powder according to claim 1, wherein the heat treatment is conducted at a temperature of 800° C. or higher.

7. The process for producing a noble-metal powder according to claim 1, wherein the heat treatment is conducted in an inert atmosphere or a reducing atmosphere.

* * * * *